United States Patent [19]

O'Connor

[11] 4,413,792

[45] Nov. 8, 1983

[54] APPARATUS FOR AUTOMATIC TRAVERSE WINDING OF TAPES ON A CYLINDRICAL CORE

[76] Inventor: Lawrence O'Connor, P.O. Box 489, Lot 6, Clearwater Bay, Keewatin, Ontario, Canada, P0X 1C0

[21] Appl. No.: 287,201

[22] Filed: Jul. 27, 1981

Related U.S. Application Data

[63] Continuation-in-part of Ser. No. 71,989, Sep. 4, 1979, abandoned.

[51] Int. Cl.[3] ..... B65H 17/02; B65H 54/28

[52] U.S. Cl. ..... 242/67.1 R; 242/158 R; 242/158 F; 242/158.4 R; 242/DIG. 2

[58] Field of Search ..... 242/158 R, 158 F, 158.2, 242/158.4 R, 158.4 A, 55, 67.1 R, DIG. 2

[56] References Cited

U.S. PATENT DOCUMENTS

| | | | |
|---|---|---|---|
| 1,641,300 | 9/1927 | Spencer | 242/158 F |
| 2,647,698 | 8/1953 | Woolley | 242/158 F |
| 2,699,297 | 1/1955 | Weinreich et al. | 242/158.4 R X |
| 2,773,391 | 12/1956 | Bruestle | 242/158.4 R X |
| 2,933,265 | 4/1960 | Lorenz | 242/158 F |
| 4,093,146 | 6/1978 | Haley | 242/158.4 R X |

FOREIGN PATENT DOCUMENTS

| | | | |
|---|---|---|---|
| 139061 | 10/1950 | Australia | 242/158 F |
| 861441 | 1/1953 | Fed. Rep. of Germany | 242/158.2 |
| 1109487 | 9/1955 | France | 242/158 F |
| 413903 | 12/1945 | Italy | 242/158 F |
| 836411 | 6/1960 | United Kingdom | 242/158.4 R |
| 836412 | 6/1960 | United Kingdom | 242/158.4 R |

*Primary Examiner*—Stanley N. Gilreath
*Attorney, Agent, or Firm*—Stanley G. Ade

[57] ABSTRACT

A power driven cylindrical core is positioned on a traversing carriage and arranged to accept on its exterior surface a series of layers of helically wound tape, with the traversing of the carriage controlled by an automatically reversing mechanism with servo control to propel the carriage at an adjustable rate in accordance with the tape width, to provide a succession of evenly wound layers of tape which may be easily unwound in subsequent manufacturing processes.

17 Claims, 7 Drawing Figures

APPARATUS FOR AUTOMATIC TRAVERSE WINDING OF TAPES ON A CYLINDRICAL CORE

This invention is a continuation-in-part application of Ser. No. 071,989, filed Sept. 4th, 1979 and now abandoned.

BACKGROUND OF THE INVENTION

The invention relates to the winding of plastic or metallic foil tapes, or combinations or laminations thereof, used in the manufacture of telecommunication cables and the like.

Such tapes, which form protective moisture and dielectric barriers around the wire bundle in such cables, are normally produced in spiral rolls which are mounted on payout stands in the plant of the cable manufacturer, and led into the machinery which simultaneously wraps the tape around the wire bundle and extrudes a plastic jacket over the wire bundle and tape assembly.

Such an operation, once started, cannot be stopped without ruining the cable, so it is desirous that rolls of tape should be as long as possible, to avoid changing rolls during the cable making process, and the hazard of making splices between tape rolls while the cable is in motion.

However, there are physical limitations to the size of rolls of tape which can be handled without damage thereto or "telescoping", and these limitations have resulted in costly and time consuming problems in cable production.

For example, tape splicing machines exist which permit splicing to be undertaken without stopping the wrapping process. Prior art known to applicant comprises U.S. Pat. Nos. 4,083,515 which discloses method and apparatus for determining and controlling wire spacing on a spool, 3,456,899 which deals with a winch winding assembly, 3,779,480 which shows a translating winder for electrical cables, 3,979,084 which is for the winding of tubes, 3,023,888 illustrating a method and apparatus for coiled strip ribbing and 3,997,122 covering a tape supply package for wrapping a plurality of different tapes around an electric conductor. French Pat. No. 1,368,354 shows a relatively conventional method of tape spooling.

SUMMARY OF THE INVENTION

It is the object of this invention to provide apparatus for winding tapes helically on a suitable core, in successive layers, in lengths which will equal or exceed those of the longest cables currently produced, which will eliminate on-line splices during cable manufacture, provide a shipping, handling, and unreeling means which will eliminate damage, and altogether provide a product which is eminently suited to the purpose for which it has been designed.

In accordance with the invention there is provided apparatus for traverse winding of flat tape on a cylindrical core comprising in combination a supporting framework, a traversing carriage mounted for side to side reciprocation upon said supporting framework, means to detachably mount the cylindrical core on said carriage, means to rotate the core as said carriage reciprocates, said last mentioned means including a source of power operatively and adjustably connectable to said core, means to move said carriage from side to side upon said framework and means to control the speed of movement of said carriage, said means to control the speed of movement of said carriage including a lead screw journalled for rotation in said carriage and being operatively connected to the source of power and a bore nut operatively engaging said lead screw and being fixedly secured to said framework, variable drive means operatively connected between said source of power and said lead screw to control the speed of rotation of said lead screw and hence the speed of movement of said carriage, in synchronism with the speed of rotation of said cylindrical core.

With the foregoing in view, and other advantages as will become apparent to those skilled in the art to which this invention relates as this specification proceed, the invention is herein described by reference to the accompanying drawings forming a part hereof, which includes a description of the preferred typical embodiment of the principles of the present invention, in which:

DESCRIPTION OF THE DRAWINGS

In the drawings like characters of reference indicate corresponding parts in the different figures.

DETAILED DESCRIPTION

Proceeding therefore to describe the invention in detail, reference should be made to the drawings in which the modular supporting structure is preferably composed of a pair of upright tubular members 11 and 12, of substantially rectangular section, welded to bases 13 and 14 arranged to be firmly fixed to the floor or other supporting structure.

Members 11 and 12 are tied together by means of horizontal tubular members 15 and 16, these being attached to the aforesaid upright members 11 and 12 by suitable bolting parts or other conventional means.

Figure 1:
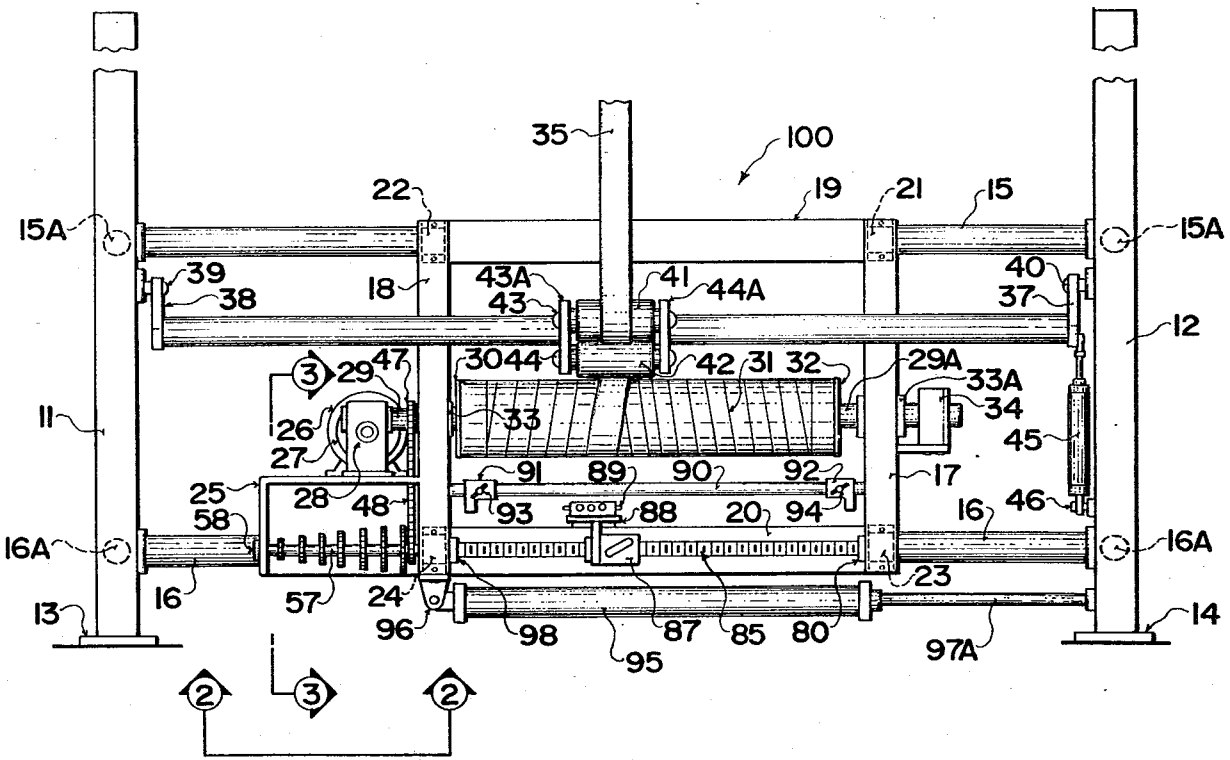
In FIG. 1 is a front elevation of one module of the device.

To form a self-supporting structure, additional uprights 11 and 12 (not illustrated) may be added to the rear of those shown in FIG. 1, and tied together with suitable fore and aft members 15A and 16A to form a rectangular structure, these again being tied laterally with additional members 15 and 16. A further apparatus may then be mounted upon these members. Additionally, the upper portions of members 11 and 12 may be used to support a further apparatus, and this concept may be carried out further by expanding the first module laterally, each module then being capable of supporting four sets of apparatus. Each set of apparatus will be identical to that which is hereinafter described.

A traversing carriage 100 consisting of side plate members 17 and 18 joined together by horizontal members 19 and 20 bolted thereto, is arranged to be freely and slidably mounted on members 15 and 16 by means of split bearing caps 21, 22, 23, and 24, which are suitably attached to plate members 17 and 18 by conventional means such as bolts 17A, 18A.

Transmission housing 25 is welded or otherwise secured to side plate member 18, and provides a base for a source of power such as motor 26 on whose output shaft is attached a conventional variable-pressure air clutch 27, whose output coupling in turn is affixed to input shaft of speed reducer 28. Output shaft 29 of speed reducer 28 extends through side members 18, (supported by bearing 33) and has mounted on its end a core support flange 30, which by means of projections (not illustrated) on its major axial face, firmly engages core 31, this latter of cylindrical layered paperboard construction which is conventional.

Supporting the opposite end of core 31 is core support flange 32, secured to shaft 29A which is arranged to be slidably and rotationally mounted in bearing 33A attached to side plate 17. Air cylinder 34, also attached to side plate 17, is arranged to exert axial pressure on core support flange 32 via shaft 29A while still allowing it to rotate freely. Removal of pressure from cylinder 34 causes flange 32 to move outwardly thus freeing core 31 for unloading and replacement by another core. Control of pressure to cylinder 34 is supplied by a conventional valve and pressure regulator assembly 34A well known to anyone skilled in the art.

Flat tape 35, of single ply, laminated construction, and of plastic material, metallic foil, or a combination thereof, is shown emerging from established processing and slitting machinery (not illustrated) well known in the art, and entering lay-on roller 41, passing over and entering between roller 41 and roller 42, passing around said roller 42 and emerging between said roller 42 and core 31. Rollers 41 and 42 are arranged to rotate on shafts 43 and 44. Friction devices and pressure devices may be employed to urge rollers 41 and 42 into intimate contact with each other, which prevents undesirable lateral movement of tape 35 during the winding process.

Figure 4:
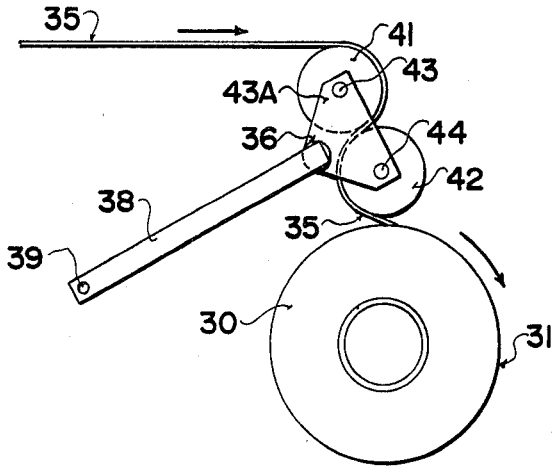
FIG. 4 is a fragmentary schematic side elevation of the lay-on roller assembly per se.
Figure 5:
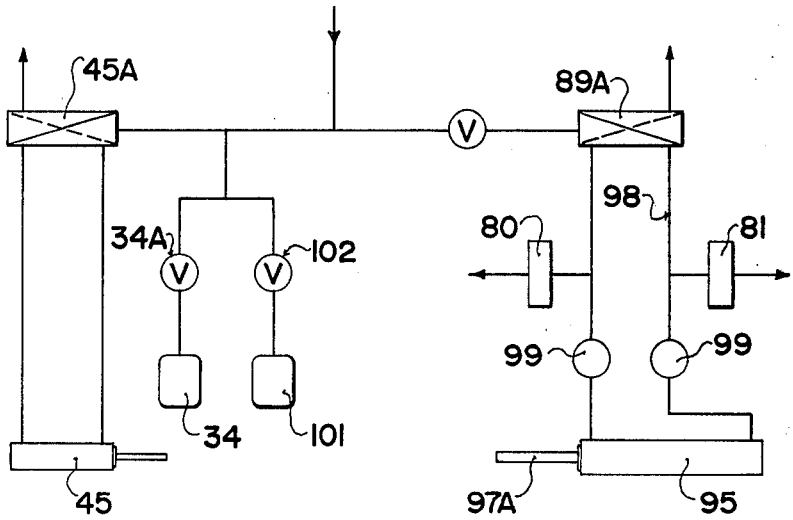
FIG. 5 is a schematic view of the pneumatic circuit.
Figure 4A:
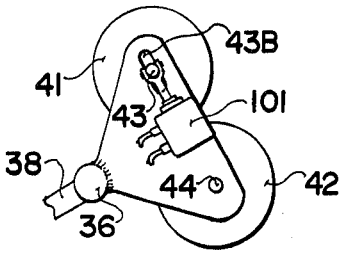
FIG. 4A is a fragmentary view similar to FIG. 4 showing a pressure adjustment for the rollers.

FIG. 4A shows one embodiment of such a device. One roller shaft 43 is mounted in slot 43B in plates 43A and 44A. An air operated piston and cylinder assembly 101 is mounted on one of the plates and operatively connected to a source compressed air (not illustrated) and controlled by a valve 102 (FIG. 5) to move the roller 41 towards or away from roller 42 thus controlling the pressure of the rollers with one another and upon the tape passing therebetween.

Rollers 41 and 42 (supported in triangular brackets 43A and 44A) are part of the lay-on roller assembly consisting of a transverse horizontal member 36 (to which brackets 43A and 44A are secured) and support arms 37 and 38 extending from each end thereof and which are arranged to swivel freely in bearings 39 and 40 attached to uprights 11 and 12. Air cylinder 45, attached to support arm 37, is also attached to upright 12 by swivel and bearing 46 and arranged to govern the weight which the lay-on roller assembly places upon core 31, this being achieved by a conventional valve and pressure regulator assembly 45A (FIG. 5) well known in the art. Full pressure on cylinder 45 lifts the lay-on roller assembly (as shown in FIG. 4) to facilitate removal of fully wound tape and core packages and the placement of new cores.

Figure 2:
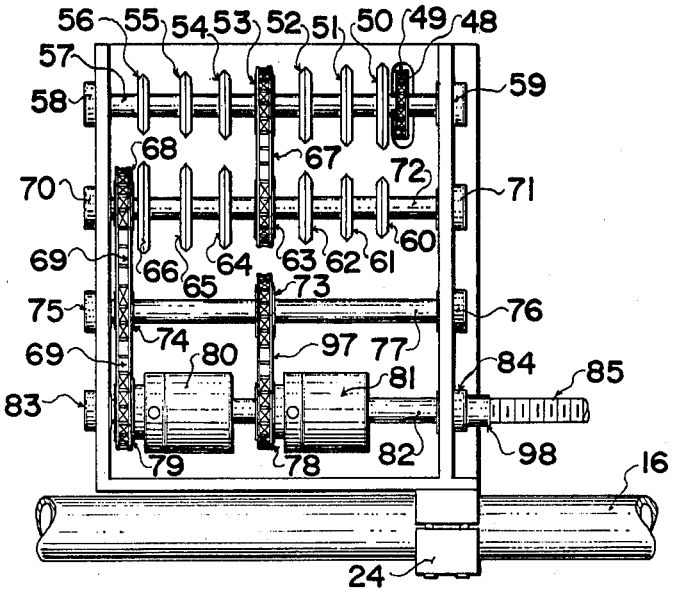
FIG. 2 is a fragmentary view along the line 2—2 of FIG. 1.

Sprocket 47, located on output shaft 29 and firmly affixed thereto, drives chain 48 which passes through a suitable opening in transmission housing 25 and around driven sprocket 49 fixed on shaft 57 supported in bearings 58 and 59. Referring to FIG. 2, shaft 57 has also affixed upon it a series of sprockets of varying pitches 50, 51, 52, 53, 54, 55 and 56, any one of which may be connected by chain 67 to inversely pitched opposing sprockets 60, 61, 62, 63, 64 and 65, and 66 respectively which are mounted upon and firmly affixed to shaft 72 mounted in bearings 70 and 71. It will be appreciated that affixing chain to sprockets 56 and 66, for example, will provide a lower relative speed to shaft 72 in comparison to shaft 57, and moving chain 67 to sprockets 50 and 60 will provide a higher relative speed between the aforesaid shafts, and the combinations of sprockets in between will provide a range of speed variations, between shafts 57 and 72. It should also be noted that a greater or lesser number of speed change sprockets may be used to provide a greater or lesser number of speed variations. In addition, a tensioning device (not shown) may be provided for convenience in moving chain 67 from one set of sprockets to another.

Figure 3:
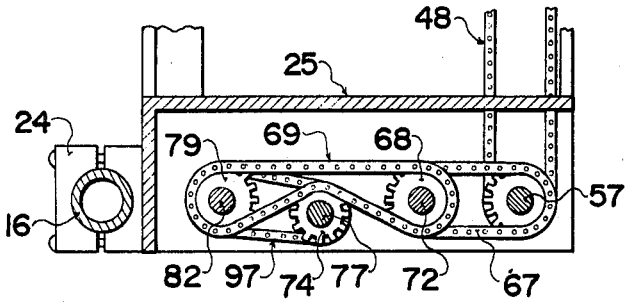
FIG. 3 is a fragmentary cross sectional view along the line 3—3 of FIG. 1.

Referring now jointly to FIGS. 2 and 3, sprocket 68 mounted on and firmly affixed to shaft 72, has in conjunction therewith, chain 69, which in turn passes in arcuate engagement with sprocket 74 on reverse countershaft 77, said countershaft being supported in bearings 75 and 76, and said sprocket 74 being firmly affixed to countershaft 77. Chain 69 then passes around sprocket 79 which is firmly affixed to conventional air clutch 80, said clutch being mounted on shaft 82, which is supported on bearings 83 and 84 and arranged to rotate freely upon said shaft when no air pressure is applied to the said clutch 80, but arranged to rotate as if firmly affixed thereto when suitable air pressure is applied.

Also firmly affixed to countershaft 77 is sprocket 73, and engaged therewith is chain 97 which also engages sprocket 78 which is firmly affixed to conventional air clutch 81, said clutch being arranged to rotate freely upon shaft 82 when no air pressure is applied, but arranged to rotate as if firmly affixed thereto when subject to air pressure.

It will therefore be seen that when unidirectional rotation is applied to shaft 57, through chain 48, a variable speed unidirectional rotation, depending on the sprocket combinations chosen, it applied to shaft 72, and that this rotation is transferred without change in speed or direction to shaft 82 when air clutch 80 is energized, and transferred without change in speed but with change in direction when clutch 81 is energized.

Shaft 82 is directly connected by coupling 98 to a lead screw 85, whose opposite end is supported in bearing 86 in place 17, which combines resistance to both radial and axial loads. Lead screw 85 is coupled to ball nut 87, which in turn is firmly affixed to stationary bracket or plate 88, extending rearwardly therefrom and which in turn is directly attached to tubular cross member 16 by suitable clamps such as 88A or any other conventional means. This mounts the plate 88 clear of the member 20 so that rotation of the lead screw 85 moves the traversing carriage 100 in one direction or the other depending upon the direction of rotation of the lead screw.

Supported by bracket 88 is a conventional double ended limit switch 89, which is actuated by adjustable dogs or stops 91 and 92 slidably mounted on bar 90 which is preferably rectangular in cross section and, which in turn is firmly affixed to side members 17 and 18. Dogs 91 and 92 may be locked in position by thumbscrews 93 and 94. This controls the movement of the carriage and prevents the bracket 88 from striking the side plates 17 and 18.

Figure 6:
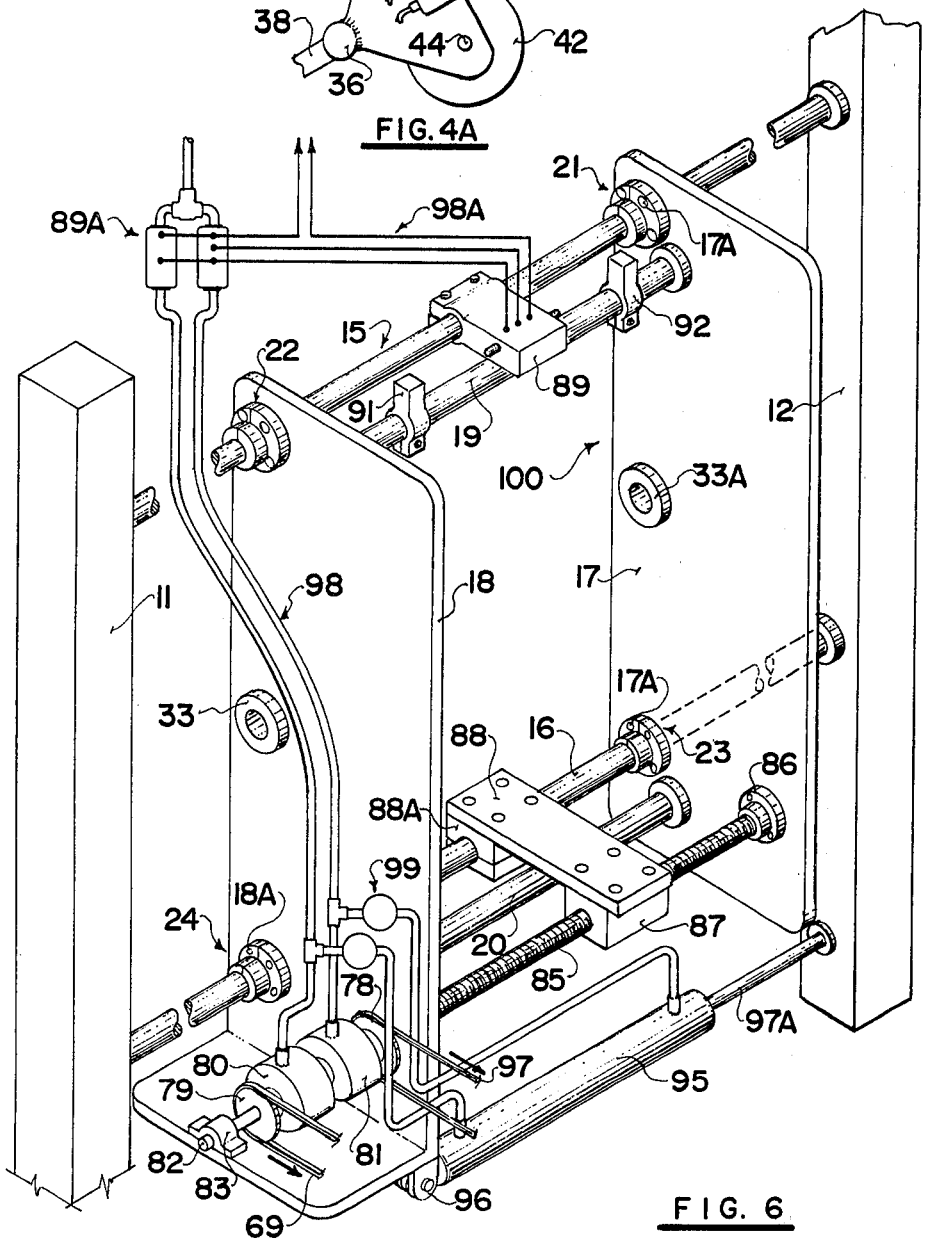
FIG. 6 is a fragmentary, partially schematic and isometric view of the central portion of FIG. 1.

FIG. 6 shows an alternative mounting for the limit switch 89 clamped to member 15 between the plates 17 and 18. The dogs 91 and 92 in this embodiment are adjustably mounted on the bar 19 one upon each side of the switch 89 which is operatively connected to solenoid valves 89A as will hereinafter be described.

An air cylinder 95 is mounted horizontally below the traversing carriage 100, and arranged to be connected to side member 18 by trunnion 96. Piston rod 97A of cylinder 95 is attached to upright 12 as shown. Flexible air piping or tubing 98 and pressure regulators 99 connect a suitable source of compressed air supply to solenoid valves 89A, which are arranged to simultaneously apply air pressure to clutch 80 and one end of cylinder 95 when limit switch 89 is in one position. In the other position of switch 89, air is supplied to clutch 81 and the other end of cylinder 95 via the other assembly of solenoid valves 89A and regulator 99. Electrical connections 98A extend from switch 89 and valves 89A to control same.

In operation, air pressure is removed from cylinder 34, causing an internal spring therein to move core support flange 32 outwardly. Empty core 31 is then positioned on flange 30, and air pressure applied to cylinder 34, causing it to move inwardly and hold core 31 in position between flanges 30 and 32, with its rotation locked to that of output shaft 29 on speed reducer 28.

A combination of sprockets is chosen, which in conjunction with the pitch of lead screw 85, will provide the desired lap on tape 35 as it is wound on rotating core 31. This may vary from half lap to no lap at all, depending on the width and characteristics of the tape 35. Having affixed the end of tape 35 to core 31 by any suitable means, air pressure is applied to clutch 80 and the appropriate end of cylinder 95. Air pressure is then applied to clutch 27 and the apparatus is rotated at the desired tension controlled by clutch 27, the speed being controlled by the tape processing slitting machinery. Simultaneously, rotation of lead screw 85 controls the reciprocation of the traversing carriage 100 along members 15 and 16, the motive force for such movement being supplied by the force generated by cylinder 95. At the end of the desired width of tape to be wound on core 31, dog 92 is engaged by the limit switch 89 thus moving the switch 89 to its opposite position, simultaneously deenergizing solenoid valve 89A and clutch 80 and shutting off air from one end of cylinder 95. Also simultaneously, clutch 81 is energized along with air being supplied to the opposite end of cylinder 95, reversing the rotation of lead screw 85 and causing it to control the rate of movement in the return direction, power for such movement being supplied by pressure in the appropriate end of cylinder 95. At the other end of the stroke of the traversing apparatus, dog 91 provides the reversing action by operating limit switch 89 in the opposite direction.

The pressure in both directions of movement in cylinder 95 are controlled by regulators 99 so that no appreciable traversing load is imposed on lead screw 85, the power for this being provided by cylinder 95. Under such conditions, the air pressure applied to clutch 27 may be closely controlled to adjust tension on tape 35, without this part of the apparatus bearing any of the traversing load. This includes all the chain drive and sprocket assemblies, clutches 80 and 81, and lead screw 85 whose only function is to regulate the rate of traverse without providing any appreciable amount of the forces necessary for such traversing.

It will therefor be apparent that the helical winding of the tape will proceed automatically, with the traversing carriage reversing itself at each limit of the desired distance of travel, controlled by the position of dogs 91 and 92, thus providing successive layers of tape to the desired package size, resulting in a product which is not subject to "telescoping", and is conveniently shipped in easily handed packaging in lengths high acceptable to the cable manufacturers.

It should be stressed that this apparatus differs from conventional cable winding apparatus because cable is flexible in all planes whereas tape is only flexible in one plane. Futhermore in cable winding machines, the cable may be used to control the rate of traverse but this is not practicable or possible when winding tape onto a core. In the present device, the rate of traverse may be set precisely and accurately by means of the lead screw which controls the traversing action but does not provide the power therefore which is supplied by the cylinder 95. The traversing action is in preset synchronization with the rotation of the cylindrical core but is not powered by the input torque of the motor and air clutch driving the core but is controlled by it.

It will be obvious that many modifications may be made to the above described apparatus without changing the basic concept, such as hydraulic control in lieu of compressed air, electric clutches in lieu of air clutches, and electrical SCR or eddy current drive in lieu of variable pressure air clutches.

Since various modifications can be made in my invention as hereinabove described, and many apparently widely different embodiments of same made within the spirit and scope of the claims without departing from such spirit and scope, it is intended that all matter contained in the accompanying specification shall be interpreted as illustrative only and not in a limiting sense.

I claim:

1. Apparatus for traverse winding of flat tape on a cylindrical core comprising a supporting framework, a traverse carriage mounted for side to side reciprocation upon said supporting framework, means to detachably mount the cylindrical core on said carriage, means for applying a predetermined rotational force to the core to rotate the core and wind the tape thereon under a predetermined tension, means for applying a motive force to said carriage to cause reciprocatory movement thereof and means for controlling the speed of reciprocatory movement of the carriage said speed controlling means being separate from and independent of said motive force applying means and including lead screw means journalled on said carriage, means for rotating the lead screw means in dependence upon the rotation of the core and nut means operatively carried on said lead screw means and attached to said framework whereby the lead screw means acts to control the speed of reciprocatory movement substantially without the application of force thereto.

2. The apparatus according to claim 1 in which said supporting framework includes a pair of spaced and parallel carriage support members, said carriage including a substantially rectangular frame and bearings in said frame mounting said carriage for reciprocal movement upon said support members.

3. The apparatus according to claim 1 in which said means to detachably mount the cylindrical core on said carriage includes a first core support flange journalled for rotation within said carriage, a second core support flange journalled for rotation in said carriage spaced apart from said first core support flange, said means to rotate said core being detachably and operatively connectable to one of said core support flanges, and core clamping means operatively connected to the other of said core support flanges.

4. The apparatus according to claim 2 in which said means to detachably mount the cylindrical core on said carriage includes a first core support flange journalled for rotation within said carriage, a second core support flange journalled for rotation in said carriage spaced apart from said first core support flange, said means to rotate said core being detachably and operatively connectable to one of said core support flanges, and core clamping means operatively connected to the other of said core support flanges.

5. The apparatus according to claim 1 in which said means for applying a motive force to move said carriage side to side in said framework includes a source of fluid under pressure, a fluid operated piston and cylinder component operatively extending between said carriage and said support framework, solenoid valves operatively connected between the source of fluid under pressure and said piston and cylinder component for alternatively reversing the action of said piston and cylinder assembly, a limit switch on said framework, and adjustable limit switch actuating means on said carriage arranged to engage the limit switch and thereby actuate the solenoid valves alternately at each end of the side to side movement of said carriage.

6. The apparatus according to claim 2 in which said means for applying a motive force to move said carriage side to side in said framework includes a source of fluid under pressure, a fluid operated piston and cylinder component operatively extending between said carriage and said support framework, solenoid valves operatively connected between the source of fluid under pressure and said piston and cylinder component for alternatively reversing the action of said piston and cylinder assembly, a limit switch on said framework, and adjustable limit switch actuating means on said carriage arranged to engage the limit switch and thereby actuate the solenoid valves alternately at each end of the side to side movement of said carriage.

7. The apparatus according to claim 3 in which said means for applying a motive force to move said carriage side to side in said framework includes a source of fluid under pressure, a fluid operated piston and cylinder component operatively extending between said carriage and said support framework, solenoid valves operatively connected between the source of fluid under pressure and said piston and cylinder component for alternatively reversing the action of said piston and cylinder assembly, a limit switch on said framework and adjustable limit switch actuating means on said carriage engaging the limit switch and thereby actuating the solenoid valves alternately at each end of the side to side movement of said carriage.

8. The apparatus according to claim 4 in which said means for applying a motive force to move said carriage side to side in said framework includes a source of fluid under pressure, a fluid operated piston and cylinder component operatively extending between said carriage and said support framework, solenoid valves operatively connected between the source of fluid under pressure and said piston and cylinder component for alternatively reversing the action of said piston and cylinder assembly, a limit switch on said framework and adjustable limit switch actuating means on said carriage engaging the limit switch and thereby actuating the solenoid valves at each end of the side to side movement of said carriage.

9. The apparatus according to claim 1 in which said means for controlling the speed of reciprocatory movement of said carriage includes means to reverse the direction of rotation of said lead screw, said last mentioned means including a reversing assembly, valve means, a pair of clutches operatively extending between said reversing assembly and said lead screw and means operatively connecting said clutches to said valve means whereby one clutch is engaged and the other clutch disengaged from said lead screw when said carriage is moving in one direction and the said one clutch is disengaged and the other said clutch engaged from said lead screw when said carriage is moving in the other direction.

10. The apparatus according to claim 2 in which said means for controlling the speed of reciprocatory movement of said carriage includes means to reverse the direction of rotation of said lead screw, said last mentioned means including a reversing assembly, valve means, a pair of clutches operatively extending between said reversing assembly and said lead screw and means operatively connecting said clutches to said valve means whereby one clutch is engaged and the other clutch disengaged from said lead screw when said carriage is moving in one direction and the said one clutch is disengaged and the other said clutch engaged from said lead screw when said carriage is moving in the other direction.

11. The apparatus according to claim 3 in which said means for controlling the speed of reciprocatory movement of said carriage includes means to reverse the direction of rotation of said lead screw, said last mentioned means including a reversing assembly, valve means a pair of clutches operatively extending between said reversing assembly and said lead screw and means operatively connecting said clutches to said valve means whereby one clutch is engaged and the other clutch disengaged from said lead screw when said carriage is moving in one direction and the said one clutch is disengaged and the other said clutch engaged from said lead screw when said carriage is moving in the other direction.

12. The apparatus according to claim 4 in which said means for controlling the speed of reciprocatory movement of said carriage includes means to reverse the direction of rotation of said lead screw, said last mentioned means including a reversing assembly, valve means, a pair of clutches operatively extending between said reversing assembly and said lead screw and means operatively connecting said clutches to said valve means whereby one clutch is engaged and the other clutch disengaged from said lead screw when said carriage is moving in one direction and the said one clutch is disengaged and the other said clutch engaged from said lead screw when said carriage is moving in the other direction.

13. The apparatus according to claim 5 in which said means for controlling the speed of reciprocatory movement of said carriage includes means to reverse the direction of rotation of said lead screw, said last mentioned means including a reversing assembly, valve means, a pair of clutches operatively extending between said reversing assembly and said lead screw and means operatively connecting said clutches to said valve means whereby one clutch is engaged and the other clutch disengaged from said lead screw when said carriage is moving in one direction and the said one clutch is disengaged and the other said clutch engaged from said lead screw when said carriage is moving in the other direction.

14. The apparatus according to claim 6 in which said means for controlling the speed of reciprocatory movement of said carriage includes means to reverse the direction of rotation of said lead screw, said last mentioned means including a reversing assembly, valve means, a pair of clutches operatively extending between said reversing assembly and said lead screw and means operatively connecting said clutches to said valve means whereby one clutch is engaged and the other clutch disengaged from said lead screw when said carriage is moving in one direction and the said one clutch is disengaged and the other said clutch engaged from said lead screw when said carriage is moving in the other direction.

15. The apparatus according to claim 7 in which said means controlling the speed of reciprocatory movement of said carriage includes means to reverse the direction of rotation of said lead screw, said last mentioned means including a reversing assembly, valve means, a pair of clutches operatively extending between said reversing assembly and said lead screw and means operatively connecting said clutches to said valve means whereby one clutch is engaged and the other clutch disengaged from said lead screw when said carriage is moving in one direction and the said one clutch is disengaged and the other said clutch engaged from said lead screw when said carriage is moving in the other direction.

16. The apparatus according to claim 8 in which said means controlling the speed of reciprocatory movement of said carriage includes means to reverse the direction of rotation of said lead screw, said last mentioned means including a reversing assembly, valve means, a pair of clutches operatively extending between said reversing assembly and said lead screw and means operatively connecting said clutches to said valve means whereby one clutch is engaged and the other clutch disengaged from said lead screw when said carriage is moving in one direction and the said one clutch is disengaged and the other said clutch engaged from said lead screw when said carriage is moving in the other direction.

17. The apparatus according to claim 1 which includes means to restrain sideways movement of the tape, said means including a pair of lay-on rollers supported in said framework and means to move the rollers into and out of operatively engagement with said core and the tape winding thereupon, said tape passing between rollers and onto said core as said core rotates, and means to adjust the pressure of said rollers one with the other.

* * * * *

UNITED STATES PATENT AND TRADEMARK OFFICE

CERTIFICATE OF CORRECTION

PATENT NO. : 4,413,792

DATED : November 8, 1983

INVENTOR(S) : Lawrence O'Connor

It is certified that error appears in the above-identified patent and that said Letters Patent is hereby corrected as shown below:

On the title page, insert:

-- /30/ Foreign Application Priority Data

Sept. 7, 1978 Australia PD5836 --.

Signed and Sealed this

*Twenty-sixth* Day of *November 1985*

[SEAL]

*Attest:*

DONALD J. QUIGG

*Attesting Officer*

*Commissioner of Patents and Trademarks*